US010982359B2

(12) United States Patent
Roe

(10) Patent No.: US 10,982,359 B2
(45) Date of Patent: Apr. 20, 2021

(54) CUSTOM-FIT SOCK AND METHOD OF MAKING THE SAME

(71) Applicant: WIGWAM MILLS, INC., Sheboygan, WI (US)

(72) Inventor: Steven K. Roe, Waldo, WI (US)

(73) Assignee: Wigwam Mills, Inc., Sheboygan, WI (US)

( * ) Notice: Subject to any disclaimer, the term of this patent is extended or adjusted under 35 U.S.C. 154(b) by 501 days.

(21) Appl. No.: 15/818,906

(22) Filed: Nov. 21, 2017

(65) Prior Publication Data

US 2019/0153638 A1 May 23, 2019

(51) Int. Cl.

| | |
|---|---|
| ***D04B 1/26*** | (2006.01) |
| ***A41B 11/00*** | (2006.01) |
| *A41B 1/08* | (2006.01) |
| *A41D 19/00* | (2006.01) |
| *A41D 1/06* | (2006.01) |
| *A41H 1/02* | (2006.01) |

(52) U.S. Cl.

CPC ..... *D04B 1/26* (2013.01); *A41B 11/00* (2013.01); *A41B 1/08* (2013.01); *A41B 2500/10* (2013.01); *A41D 1/06* (2013.01); *A41D 19/00* (2013.01); *A41D 2500/10* (2013.01); *A41H 1/02* (2013.01)

(58) Field of Classification Search

CPC . D04B 1/26; D04B 1/265; D04B 9/46; D04B 9/48; D04B 9/50; D04B 9/52

See application file for complete search history.

(56) References Cited

U.S. PATENT DOCUMENTS

| | | | | |
|---|---|---|---|---|
| 1,883,581 | A * | 10/1932 | Thornton | D04B 9/38 66/51 |
| 3,290,904 | A * | 12/1966 | Snyder | D04B 1/265 66/200 |
| 4,502,301 | A * | 3/1985 | Swallow | A61F 13/08 602/62 |
| 6,430,970 | B1 * | 8/2002 | Gardon-Mollard | D04B 1/243 66/178 A |
| 6,612,136 | B2 | 9/2003 | Roe | |
| 7,043,329 | B2 * | 5/2006 | Dias | D04B 7/32 700/141 |
| 2015/0245951 | A1 * | 9/2015 | Convert | D04B 1/18 66/178 A |

* cited by examiner

*Primary Examiner* — Danny Worrell
(74) *Attorney, Agent, or Firm* — Alston & Bird LLP

(57) ABSTRACT

A custom-fit sock is described. The sock includes a tubular body formed from a number of courses and wales. The tubular body includes a foot portion and a leg portion merging substantially at the ankle of a wearer. The foot portion defines a foot bottom portion and an upper instep portion and further includes a heel portion positioned adjacent the foot bottom portion at a first end of the foot portion and a toe portion positioned adjacent the foot bottom portion at a second end of the foot portion. A first course includes a first number of stitches formed using a first number of selected needles of the circular knitting machine. The first number of selected needles is less than a total number of needles of the circular knitting machine.

16 Claims, 4 Drawing Sheets

CUSTOM-FIT SOCK AND METHOD OF MAKING THE SAME

FIELD OF THE INVENTION

The present disclosure relates generally to custom-fit socks, and more particularly to socks having a customized number of stitches in each course.

BACKGROUND

In general, conventional socks are formed by knitting the hem or welt first, followed by the leg, heel, foot, and then toe. After the toe is knit, a seam is formed to attach the opposite sides of the toe pocket to each other, closing the toe. Conventional socks may be manufactured in a variety of sizes and may be designed for particular ages, genders, activities, and the like. Socks that do not conform to a wearer's foot may cause chafing, blisters, and other painful conditions, particularly for active individuals who spend a lot of time on their feet, such as professional athletes.

The inventor has identified a number of deficiencies and problems associated with the conventional socks and associated methods described above. Through applied effort, ingenuity, and innovation, many of these identified problems have been solved by developing solutions that are included in embodiments of the present invention, many examples of which are described in detail herein.

BRIEF SUMMARY

Embodiments of the invention described herein provide improved socks and methods for making the same. In particular, the inventor has identified a need for socks that are customized to fit the foot of a wearer. Accordingly, embodiments of the socks described herein are formed to conform more exactly to the foot of a wearer to provide an optimal fit.

Accordingly, embodiments of the invention provide a sock formed on a circular knitting machine from at least one yarn. The sock comprises a tubular body formed from a plurality of courses and wales and having a foot portion and a leg portion merging substantially at the ankle of a wearer. The foot portion defines a foot bottom portion and an upper instep portion and further comprises a heel portion positioned adjacent the foot bottom portion at a first end of the foot portion and a toe portion positioned adjacent the foot bottom portion at a second end of the foot portion. A first course comprises a first number of stitches formed using a first number of selected needles of the circular knitting machine, and the first number of selected needles is less than a total number of needles of the circular knitting machine.

According to certain embodiments, non-selected needles of the first course may be non-adjacent to other non-selected needles of the first course. In some embodiments, the first number of stitches may be determined via three-dimensional imaging of the foot of the wearer.

According to certain embodiments, a second course may comprise a second number of stitches formed using a second number of selected needles of the circular knitting machine. In some embodiments, the second number of selected needles may be less than the total number of needles of the circular knitting machine. In certain embodiments, the second course may be adjacent the first course. In further embodiments, the first number of selected needles may be different than the second number of selected needles. In some embodiments, non-selected needles of the second course may be non-adjacent to other non-selected needles of the second course. In further embodiments, the second number of stitches may be determined via three-dimensional imaging of the foot of the wearer.

In another aspect, a method of knitting a sock on a circular knitting machine is provided. In such a method, the sock comprises a tubular body formed from a plurality of courses and wales and having a foot portion and a leg portion merging substantially at the ankle of a wearer such that the foot portion defines a foot bottom portion and an upper instep portion and further comprises a heel portion positioned adjacent the foot bottom portion at a first end of the foot portion and a toe portion positioned adjacent the foot bottom portion at a second end of the foot portion. The method includes selecting a number of needles for each course to achieve a determined circumferential length of the course to custom fit the foot of a wearer, and knitting a first course. The first course comprises a first number of stitches formed using a first number of selected needles of the circular knitting machine, and the first number of selected needles is less than a total number of needles of the circular knitting machine.

According to certain embodiments, the method may further comprise providing a three-dimensional image of the foot of the wearer, and selecting the number of needles for each course to achieve the determined circumferential length of the course as determined by the three-dimensional image of the foot of the wearer. In some embodiments, non-selected needles of the first course may be non-adjacent to other non-selected needles of the first course.

According to certain embodiments, the method may further comprise knitting a second course. In some embodiments, the second course may comprise a second number of stitches formed using a second number of selected needles of the circular knitting machine. In further embodiments, the second number of selected needles may be less than the total number of needles of the circular knitting machine. In certain embodiments, the second course may be adjacent the first course. In further embodiments, the first number of selected needles may be different than the second number of selected needles. In some embodiments, non-selected needles of the second course may be non-adjacent to other non-selected needles of the second course. In certain embodiments, the method may further comprise closing the toe portion.

In yet another aspect, a knit article formed on a circular knitting machine from at least one yarn is provided. The article comprises a tubular body having a plurality of courses and wales such that a first course comprises a first number of stitches formed using a first number of selected needles of the circular knitting machine, and the first number of selected needles is less than a total number of needles of the circular knitting machine.

According to certain embodiments, the article may comprise a sleeve, a cuff, a pant leg, a shirt, a unitard, a waistband, an undergarment, a glove, or a sock. In some embodiments, non-selected needles of the first course may be non-adjacent to other non-selected needles of the first course. In further embodiments, the first number of stitches may be determined via three-dimensional imaging of a body part of a wearer to achieve a desired circumferential length.

According to certain embodiments, a second course may comprise a second number of stitches formed using a second number of selected needles of the circular knitting machine. In some embodiments, the second number of selected needles may be less than the total number of needles of the circular knitting machine. In certain embodiments, the second course may be adjacent the first course. In further embodiments, the first number of selected needles may be different than the second number of selected needles. In some embodiments, non-selected needles of the second course may be non-adjacent to other non-selected needles of the second course. In further embodiments, the second number of stitches may be determined via three-dimensional imaging of a body part of a wearer to achieve a desired circumferential length.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Conventional socks may be manufactured in a variety of sizes and may be designed for particular ages, genders, activities, and the like. Socks that do not conform to a wearer's foot may cause chafing, blisters, and other painful conditions, particularly for active individuals who spend a lot of time on their feet, such as professional athletes. Other knit articles, like clothing items such as shirts, undergarments, and the like, may pose similar problems. For example, areas of excess fabric may bunch and apply excess pressure or friction to corresponding areas of contact with the wearer's skin as the wearer moves. Conversely, areas of fabric that are sized too small may cut off circulation or cause irritation to the wearer.

Through applied effort, ingenuity, and innovation, many of these identified problems have been solved by the inventor. Accordingly, embodiments of the invention provide improved custom-fit socks, methods for knitting custom-fit socks, and custom-fit knit articles that are designed to specifically match the configuration (e.g., size and shape) of the corresponding body part of the wearer on which the article is worn.

Figure 1:
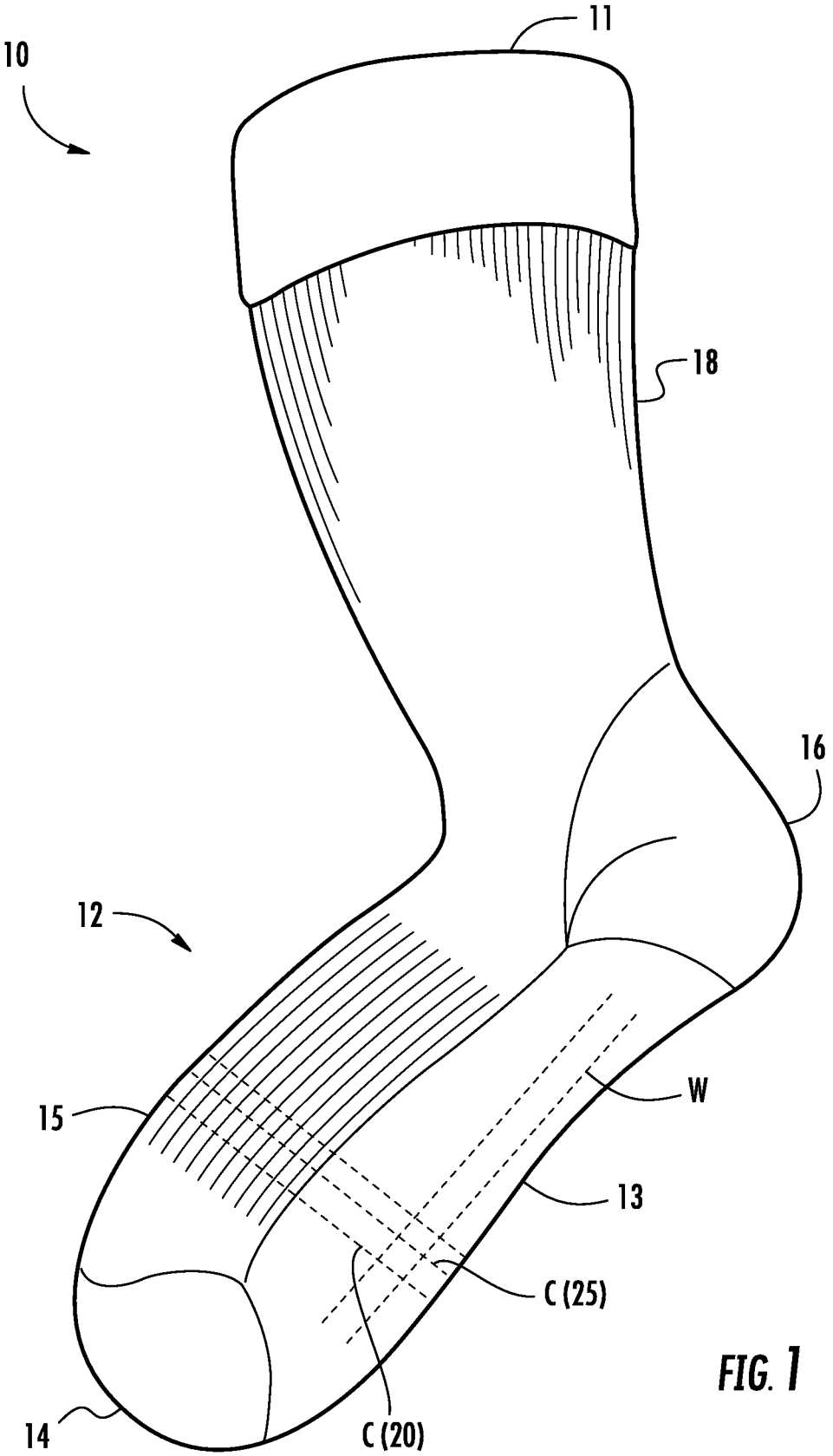
FIG. 1 is a perspective view of a sock according to an example embodiment of the invention.

Turning now to FIG. 1, a custom-fit sock 10 is illustrated according to an example embodiment of the invention. The sock 10 may be single-layered or may be completely or partially knit of a double layer construction. In certain embodiments in which the sock includes double layer construction, such portions may be characterized by two layers being connected together at spaced apart locations during the knitting thereof, such as described in U.S. Pat. No. 6,612,136 and U.S. patent application Ser. No. 15/609,172, incorporated herein by reference. Turning to the sock in more detail, the sock 10 has foot portion 12 extending from a toe portion 14 to a heel portion 16, and a leg portion 18 extending from the heel portion 16 of the foot portion 12 to a top opening (e.g., a cuff 11) at its upper end. The foot portion 12 and the leg portion 18 merge substantially at the ankle of a wearer. The foot portion 12 also defines a foot bottom portion 13 and an upper instep portion 15. The heel portion 16 is positioned adjacent the foot bottom portion 13 at a first end of the foot portion 12, and the toe portion 14 is positioned adjacent the foot bottom portion 13 at a second end of the foot portion 12. According to embodiments of the present invention, the sock 10 is formed from a plurality of courses C and wales W, with each course having a selected number of stitches customized to correspond the size of the course to a size of the foot of the wearer at a corresponding location. For example, a first course 20, described in more detail below with regard to FIG. 2A, may comprise a first number of stitches, while a second course 25, described in more detail below with regard to FIG. 2B, may comprise a second number of stitches that differs from the first number of stitches.

Figure 2A:
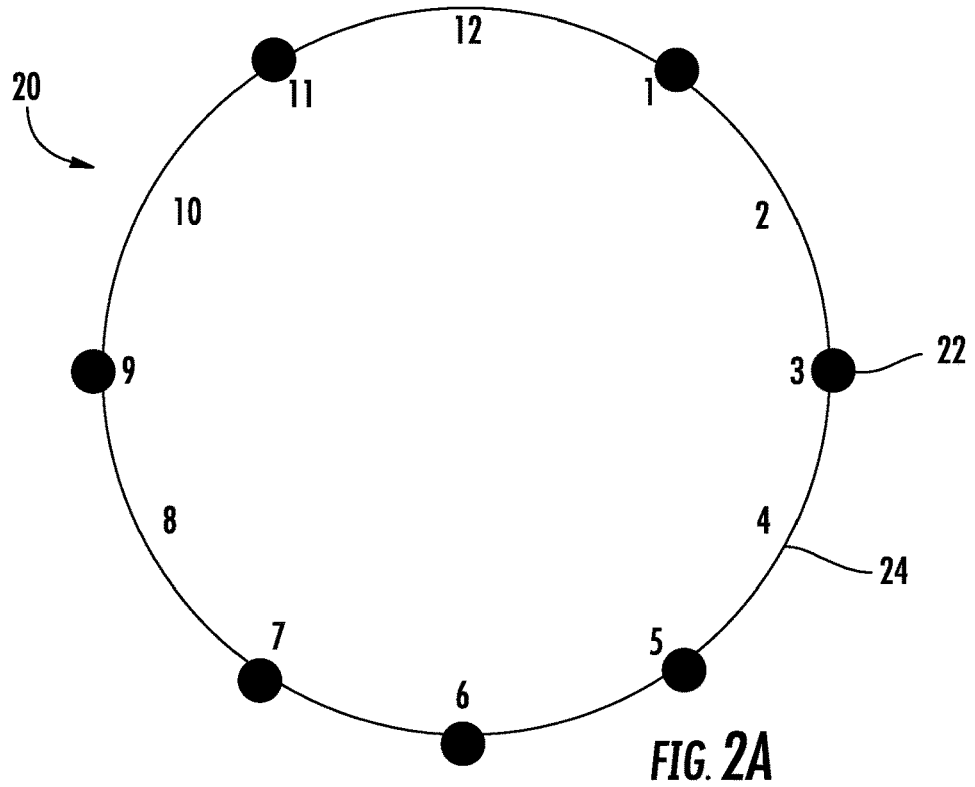
FIGS. 2A and 2B are schematic illustrations of needle selection individualized by course according to an example embodiment of the invention.

As shown in FIG. 2A, a configuration for a first course 20 may use a first number of selected needles 22 of the circular knitting machine. The first number of selected needles 22 may be less than a total number of needles of the circular knitting machine. The first course 20 may include a first number of stitches that corresponds to the first number of selected needles 22. The non-selected needles 24 of the first course 20 may be non-adjacent to other non-selected needles of the first course.

For example, in the illustrated example of FIG. 2A, the first course 20 includes 12 needles, numbered 1-12. Of the 12 needles, needles 1, 3, 5, 6, 7, 9, and 11 are selected needles, such that these selected needles will be used to form stitches for the first course 20. Thus, the first course 20 in this example will have seven (7) stitches. Needles 2, 4, 8, 10, and 12 are non-selected needles of the first course 20. Thus, in this example, the five (5) non-selected needles will be prevented from forming stitches for the first course 20. As a result, out of a maximum of 12 stitches, only 7 stitches will be formed for the first course 20, such that a corresponding circumferential length of the first course 20 is shorter than the length if all of the needles (1 through 12) were used to form the stitches.

Figure 2B:
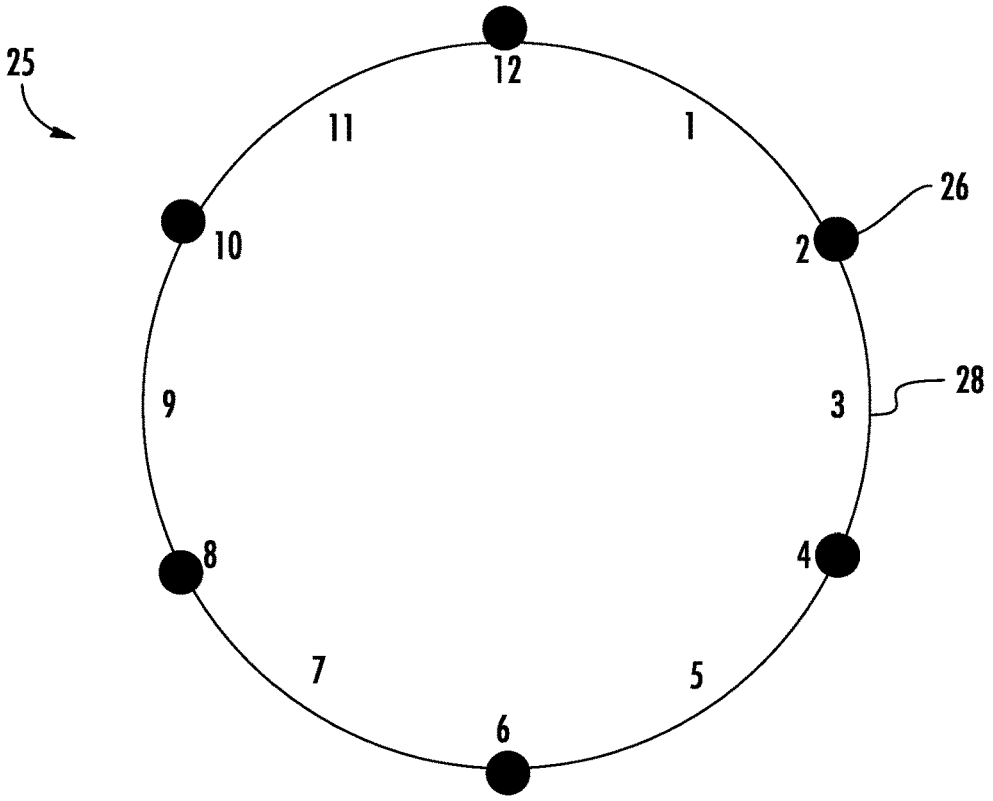

FIG. 2B illustrates a configuration for a second course 25. The second course 25 may use a second number of selected needles 26 of the circular knitting machine. The second number of selected needles 26 may be less than a total number of needles of the circular knitting machine. The second course 25 may include a second number of stitches that corresponds to the second number of selected needles 26. The non-selected needles 28 of the second course 25 may be non-adjacent to other non-selected needles of the second course. In the depicted embodiment of the sock 10, the second course 25 is adjacent the first course 20, and the first number of selected needles 22 is different than the second number of selected needles 26.

For example, in the illustrated example of FIG. 2B, the second course 25 includes 12 needles, numbered 1-12. Of the 12 needles, needles 2, 4, 6, 8, 10, and 12 are selected needles, such that these selected needles will be used to form stitches for the second course 25. Thus, the second course 25 in this example will have six (6) stitches. Needles 1, 3, 5, 7, 9, and 11 are non-selected needles of the second course 25.

Thus, in this example, the six (6) non-selected needles will be prevented from forming stitches for the second course 25. As a result, out of a maximum of 12 stitches, only 6 stitches will be formed for the second course 25, such that a corresponding circumferential length of the second course 25 is shorter than the length if all of the needles (1 through 12) were used to form the stitches.

In this regard, each course will have a certain number of selected needles and non-selected needles that will vary from course to course. Each course may be knit in the same direction in a circular formation in accordance with the arrangement of the circular knitting machine. The term "non-selected needle(s)", as used herein, may generally refer to the process of holding back certain needles in a particular course so that these "non-selected needles" do not engage a thread. The non-selected needles may be non-adjacent both between courses and within the same course in order to prevent the visual appearance of a hole.

According to certain embodiments and as mentioned above, the number of selected needles (e.g., the first number of selected needles, the second number of selected needles, etc.) corresponds to the number of stitches in a course. In some embodiments, for example, the number of stitches in each course may be determined by measuring average foot circumference of a wearer at incremental points. In further embodiments, for instance, the number of stitches in each course may be determined via three-dimensional imaging of the foot of the wearer. For example, in some embodiments in which a course corresponds to a larger portion of the foot, the course may require a larger circumferential length. In such embodiments, for instance, a larger number of needles may be selected to remain in the active race. In other embodiments in which a course corresponds to a smaller portion of the foot, for example, the course may require a smaller circumferential length, and fewer needles may be selected to remain in the active race. For example, in a 200-needle knitting machine, reducing the circumference by 1% would remove 2 needles, and reducing the circumference by 5% would remove 10 needles. Such needles would be removed in the area where fabric is not needed. In further embodiments, only part of a course or several courses may use reduced needles to, for example, make a shape on one side of a sock. For instance, the number of stitches in the foot bottom could be reduced without reducing the instep or the sock. In this regard, each course may be tailored to a size of the corresponding portion of the body. The respective size information, as determined by, for example, three-dimensional imaging, may be input into the circular knitting machine, and the number and positioning of the selected and non-selected needles may be chosen accordingly.

In accordance with certain embodiments, the sock 10 may be knit on a conventional circular knitting machine having a cylinder and dial capable of knitting socks. In some embodiments, for example, the sock 10 may be knit on a 4-inch diameter 108-needle cylinder circular knitting machine. Other examples of such machines may include a 4-inch diameter 156-needle cylinder circular hosiery knitting machine with a cooperating dial having needles therein and with or without a LIN-TOE® toe closing device, and a 4-inch diameter 112-needle cylinder circular knitting machine with a cooperating dial and a LIN-TOE® device. Such knitting machines are conventionally provided with two yarn feeds that supply yarns to the cylinder and dial needles at spaced apart locations around the circular knitting machine. Although examples of dual feed circular knitting machines are provided, the sock may be knit on a machine with any needle count or cylinder diameter as understood by one of ordinary skill in the art, including, but not limited to, a single feed circular knitting machine, a circular knitting machine without a dial, and/or the like as long as the machine allows for needle-by-needle selection.

Figure 3:
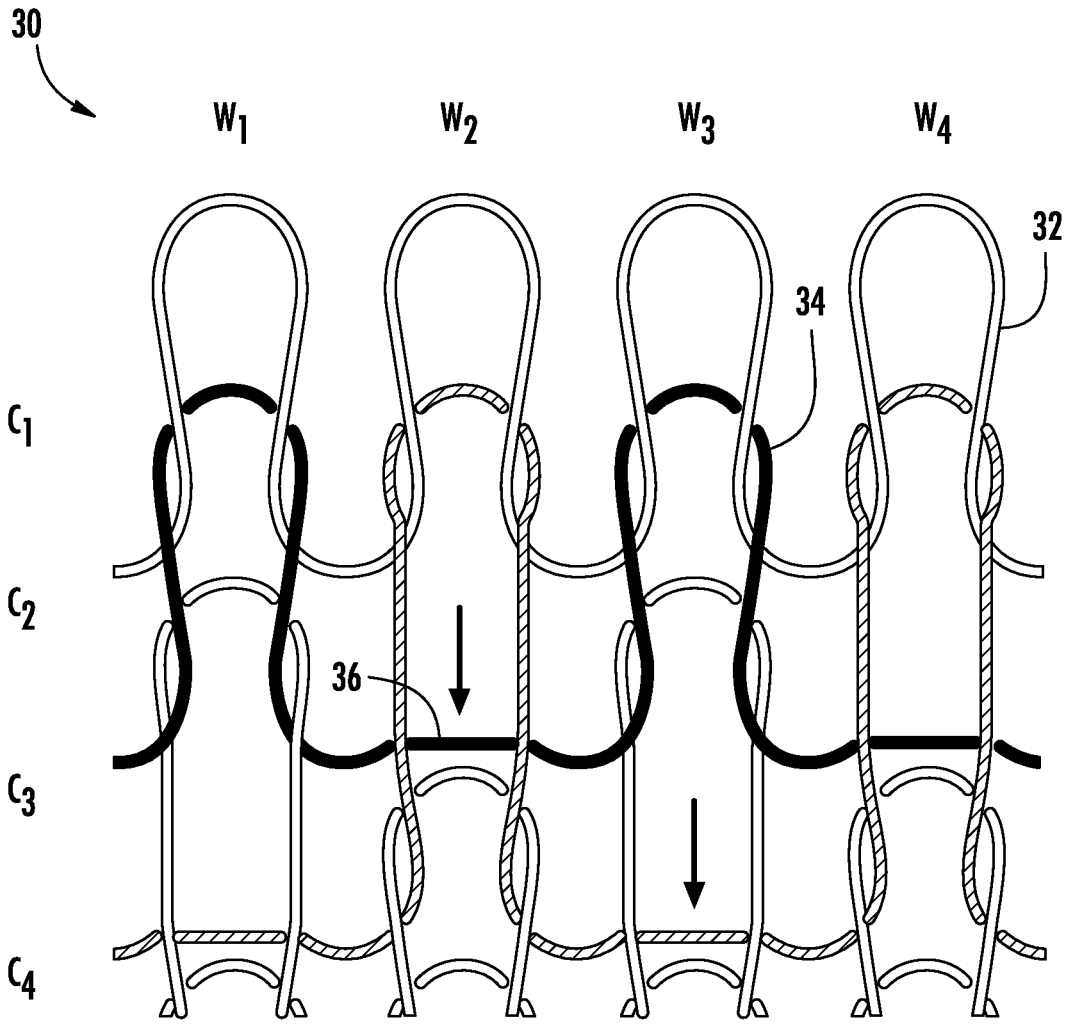
FIG. 3 is an enlarged fragmentary perspective view of the knit structure of a sock according to an example embodiment of the invention.

As shown in FIG. 3, the main yarn feed of the knitting machine (not shown) may feed a first yarn to the cylinder needles to form stitch loops 32 arranged in courses $C_1$-$C_4$ and wales $W_1$-$W_4$. FIG. 3 also illustrates an example of a stitch pattern resulting from a customized combination of selected needle stitches 34 and non-selected needle stitches (i.e., float stitches) 36. Non-selected needle stitches 36 may be straight and may not form a stitch loop as with selected needle stitches 34 because the needle is not in action for non-selected needle stitches 36. In some embodiments, and as shown in FIG. 3, the non-selected needle stitches 36 (as also indicated by the arrows) may be made, for example, by every other needle in every other course. In such embodiments, the original stitch may remain on the needle until the next course, where the stitch may be knit off. In a portion of a course having a non-selected needle, the yarns may contract to form a course having a smaller circumferential length. In this regard, the number of non-selected needle stitches 36 and their locations within the sock may control the fit of the sock, with the circumferential length decreasing as the number of non-selected needle stitches 36 increases, the circumferential length decreasing in particular in the areas of the non-selected needle stitches 36. For illustration only, the stitch pattern shown in FIG. 3 is a plain or jersey stitch pattern, but one of ordinary skill in the art in light of this disclosure would understand that the sock 10 may be knit in any desired stitch pattern.

In some embodiments, the heel portion 16 and the toe portion 14 may be made via reciprocated knitting. Reciprocated knitting, according to certain embodiments, may refer to the process of selecting opposite needles to remain in the active race and removing the remaining needles to the inactive race during knitting. In general, because the opposite needles are reciprocating, the swing of the cylinder changes to match the active needles, such that the reciprocated portions (e.g., the heel portion 16 and the toe portion 14) are knit back-and-forth rather than in the conventional circular manner. In other embodiments, however, reciprocated knitting may not be used in knitting the sock. For example, reciprocated knitting may not be used in forming a tube sock in accordance with certain embodiments. After the sock blank has been knit, the toe may be closed, such as by a LIN-TOE® device or seaming machine.

Figure 4:
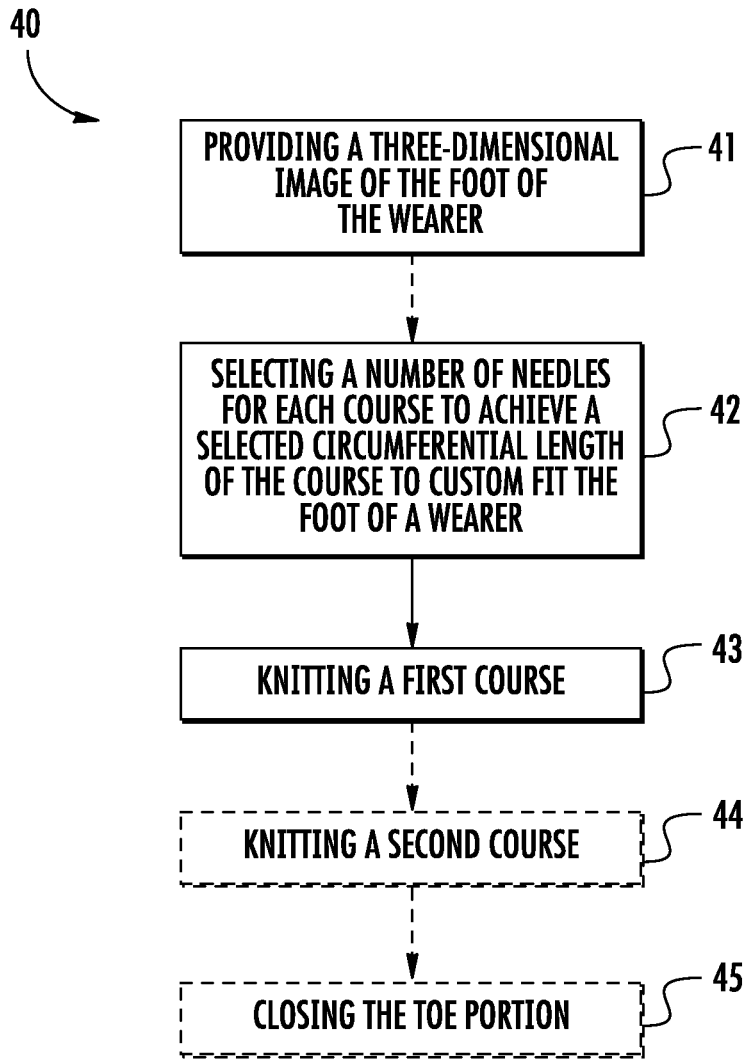
FIG. 4 is a schematic block diagram illustrating a method of knitting a sock according to an example embodiment of the invention.

In FIG. 4, for example, a schematic block diagram is shown illustrating a method 40 of knitting a sock according to an example embodiment of the invention. As shown in FIG. 4, the method 40 may optionally include an initial step of providing a three-dimensional image of the foot of the wearer at block 41. The method may further include selecting a number of needles for each course to achieve a determined circumferential length of the course to custom fit the foot of a wearer at block 42, and knitting a first course at block 43. The method may further optionally include knitting a second course at block 44, and closing the toe portion at block 45.

The sock 10 may be knit using any of various types of yarn in various weights as understood by one of ordinary skill in the art in light of this disclosure. In some cases, the selection of natural or synthetic yarn, textures, and patterns may depend on the anticipated use to which the socks may be put. For example, the sock 10 may be made thicker by selecting a higher weight yarn. As another example, the foot portion 12, such as the heel portion 16 or the toe portion 14 of the foot portion 12, may be formed using terry loops knit therein.

Further embodiments of the present invention may include a custom-fit knit fabric article. A knit fabric article may be formed on a circular knitting machine from at least one yarn. In some embodiments, for instance, the knit fabric article may comprise a sleeve, a cuff, a pant leg, a shirt, a unitard, a waistband, an undergarment, a sock, a glove, or any article that may be knit from at least one yarn on a circular knitting machine as understood by one of ordinary skill in the art.

According to certain embodiments, the knit fabric article may comprise a tubular body having a plurality of courses and wales. In some embodiments, a first course may comprise a first number of stitches formed using a first number of selected needles of the circular knitting machine. In further embodiments, a second course may comprise a second number of stitches formed using a second number of selected needles of the circular knitting machine. In certain embodiments, each of the first number of stitches and the second number of stitches may be determined via three-dimensional imaging of a body part of a wearer, as described above in more detail. The body part of the wearer that is imaged is dependent upon the desired knit fabric article and how it is meant to be worn (e.g., on what body part), as understood by one of ordinary skill in the art. In some embodiments, the non-selected needles of each of the first course and the second course are non-adjacent to other non-selected needles of the first course and the second course respectively. Each of the first number of selected needles and the second number of selected needles may be less than a total number of needles of the circular knitting machine, and the first number of selected needles may be different than the second number of selected needles. Moreover, the second course may be adjacent the first course in the knit fabric article, as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A sock formed on a circular knitting machine from at least one yarn, the sock comprising:

a tubular body formed from a plurality of courses and wales and having a foot portion and a leg portion merging substantially at the ankle of a wearer, wherein the foot portion defines a foot bottom portion and an upper instep portion and further comprises a heel portion positioned adjacent the foot bottom portion at a first end of the foot portion and a toe portion positioned adjacent the foot bottom portion at a second end of the foot portion, wherein:

a first course comprises a first number of stitches formed using a first number of selected needles of the circular knitting machine, the first number of selected needles is less than a total number of needles of the circular knitting machine, the first number of stitches is determined via three-dimensional imaging of the foot of the wearer, and the heel portion and the toe portion are reciprocated portions of the tubular body.

2. The sock according to claim 1, wherein non-selected needles of the first course are non-adjacent to other non-selected needles of the first course.

3. The sock according to claim 1, wherein:

a second course comprises a second number of stitches formed using a second number of selected needles of the circular knitting machine;

the second number of selected needles is less than the total number of needles of the circular knitting machine;

the second course is adjacent the first course; and the first number of selected needles is different than the second number of selected needles.

4. The sock according to claim 3, wherein non-selected needles of the second course are non-adjacent to other non-selected needles of the second course.

5. The sock according to claim 3, wherein the second number of stitches is determined via three-dimensional imaging of the foot of the wearer.

6. A method of knitting a sock on a circular knitting machine, wherein the sock comprises a tubular body formed from a plurality of courses and wales and having a foot portion and a leg portion, the foot portion defining a foot bottom portion and an upper instep portion and further comprising a heel portion positioned adjacent the foot bottom portion at a first end of the foot portion and a toe portion positioned adjacent the foot bottom portion at a second end of the foot portion, the method comprising:

providing a three-dimensional image of the foot of a wearer;

selecting a number of needles for each course to achieve a determined circumferential length of the course as determined by the three-dimensional image to custom fit the foot of a wearer;

knitting a first course; and reciprocating the heel portion and the toe portion, wherein the first course comprises a first number of stitches formed using a first number of selected needles of the circular knitting machine, and wherein the first number of selected needles is less than a total number of needles of the circular knitting machine.

7. The method according to claim 6, wherein non-selected needles of the first course are non-adjacent to other non-selected needles of the first course.

8. The method according to claim 6, further comprising knitting a second course, wherein:

the second course comprises a second number of stitches formed using a second number of selected needles of the circular knitting machine;

the second number of selected needles is less than the total number of needles of the circular knitting machine;

the second course is adjacent the first course; and the first number of selected needles is different than the second number of selected needles.

9. The method according to claim 8, wherein non-selected needles of the second course are non-adjacent to other non-selected needles of the second course.

10. The method according to claim 6, further comprising closing the toe portion.

11. A knit fabric article formed on a circular knitting machine from at least one yarn, the article comprising:

a tubular body having a plurality of courses and wales, wherein:

a first course comprises a first number of stitches formed using a first number of selected needles of the circular knitting machine, the first number of selected needles is less than a total number of needles of the circular knitting machine, the first number of stitches is determined via three-dimensional imaging of a body part of a wearer to achieve a desired circumferential length, and a portion of the tubular body is reciprocated.

12. The article according to claim 11, wherein non-selected needles of the first course are non-adjacent to other non-selected needles of the first course.

13. The article according to claim 11, wherein:

a second course comprises a second number of stitches formed using a second number of selected needles of the circular knitting machine, the second number of selected needles is less than a total number of needles of the circular knitting machine, the second course is adjacent the first course, and the first number of selected needles is different than the second number of selected needles.

14. The article according to claim 13, wherein non-selected needles of the second course are non-adjacent to other non-selected needles of the second course.

15. The article according to claim 13, wherein the second number of stitches is determined via three-dimensional imaging of a body part of a wearer to achieve a desired circumferential length.

16. The article according to claim 11, wherein the article comprises a sleeve, a cuff, a pant leg, a shirt, a unitard, a waistband, an undergarment, a glove, or a sock.

* * * * *